United States Patent [19]

Suzuki et al.

[11] Patent Number: 4,541,577

[45] Date of Patent: Sep. 17, 1985

[54] METHOD OF TRANSFERRING YARN PACKAGES IN A SPINNING FRAME

[75] Inventors: Osamu Suzuki, Obu; Takayuki Morita, Kariya; Shigeru Muramatsu, Okazaki; Isao Asai, Toyoda, all of Japan

[73] Assignee: Kabushiki Kaisha Toyoda Jidoshokki Seisakusho, Kariya, Japan

[21] Appl. No.: 571,858

[22] Filed: Jan. 18, 1984

[30] Foreign Application Priority Data

Jan. 25, 1983 [JP] Japan ..... 58-10773
Jan. 26, 1983 [JP] Japan ..... 58-10951

[51] Int. Cl.[4] ..... B65H 54/26; B65H 67/06
[52] U.S. Cl. ..... 242/35.5 A; 242/35.5 R
[58] Field of Search ..... 242/35.5 A, 35.5 R, 242/35.6 R; 57/266

[56] References Cited

U.S. PATENT DOCUMENTS 3,160,359 12/1964 Furst ..... 242/35.5 R
3,356,306 12/1967 Furst ..... 242/35.5 R

FOREIGN PATENT DOCUMENTS 2816418 10/1979 Fed. Rep. of Germany ..... 242/35.5 A

*Primary Examiner*—Stanley N. Gilreath
*Attorney, Agent, or Firm*—Brooks Haidt Haffner & Delahunty

[57] ABSTRACT

A method of transferring yarn packages in a spinning frame having a plurality of spinning stations arranged in a row on each longitudinal side thereof, a single run of a full package transferring conveyor disposed centrally along the machine and a doffing unit moveable along the respective spinning stations, is disclosed herein. According to a preferred embodiment of the invention, the movement of the conveyor, which is set normally in a moving state, is interrupted only if there is no doffed package on the conveyor at a doffing position corresponding to a spinning station when the doffing unit traveling around the machine comes to and stops at that spinning station, whereupon the doffing unit is operated to perform its doffing service there; but the conveyor continues to run if there is any doffed package at that doffing position, until that position becomes clear of any such package, and doffing service is provided at the station when its doffing position on the conveyor is thus cleared of any other package.

6 Claims, 7 Drawing Figures

METHOD OF TRANSFERRING YARN PACKAGES IN A SPINNING FRAME

BACKGROUND OF THE INVENTION

The present invention relates to a method of transferring yarn packages in a textile machine such as a spinning frame or a winder having a plurality of spinning or winding stations arranged in a row on each longitudinal side of the machine.

In a spinning machine comprising a plurality of spinning units, each defining a spinning station of the machine, which are juxtaposed in a row on each side thereof and a single run of package transferring conveyor which is disposed to extend centrally along the spinning stations on each side from an end to the other end of the machine for transferring doffed full packages placed thereon, wherein a full package has a width, or an axial dimension thereof which is greater than half the interval distance at which the spinning units on each side are spaced from one another, there is a fear that a full package being doffed from a spinning station on one side of the machine onto the conveyor may interfere with a full package, if any, which has already been already doffed from another spinning station positioned just opposite the station on said one side and is thus still within the doffing area for both of the opposite stations on the conveyor. Thus, the full package previously doffed and placed for storage on the conveyor will provide an obstacle to the full package to be doffed from the opposite spinning station.

FIG. 1 shows a structure of a spinning frame proposed heretofore in an attempt to avoid the problem associated with the aforementioned interference between full packages, wherein the spinning frame 1 includes two lines of package transferring conveyors 3 each disposed along a yarn winding drum 2 extending on each longitudinal side of the machine 1. In operation, when a yarn coming out from a spinning unit (not shown) and then wound by the winding drum 2 is formed into a full package 4 of any desired size, it is pushed out of its winding position onto an adjacent conveyor 3 by any suitable means mounted on a doffing unit 5. The yarn packages 4 thus doffed from the respective spinning stations are temporaily stored on the conveyor 3 temporarily for any desired length of time, whereupon the conveyors 3 are started by a machine operator so that the packages 4 may be moved with the conveyors to be delivered from the machine 1.

In this proposed structure having one package transferring conveyor run for each row of spinning stations, however, the widthwise dimension of the machine 1 will naturally be larger than in the structure having only a single conveyor line of the thus posing a disadvantage in terms of the space factor and cost for machine installation. The complicated structure of the machine due to an added conveyor is also disadvantageous in terms of maintenance thereof. In addition, because connection of the conveyors with any package transferring system of a subsequent process can be accomplished only with greater difficulty, the additional conveyor makes it more difficult to provide such connection for the purpose of automation in yarn package handling in a spinning mill.

In order to solve the aforesaid problems, a method is proposed by U.S. patent application Ser. No. 506,296 for transferring full packages in a spinning frame having a plurality of spinning stations arranged in a row on each longitudinal side of a the frame, a single run of normally-stopped package transferring conveyor disposed centrally between the opposite rows of the stations and a doffing unit for providing doffing service at each of the stations while traveling around the machine, according to which method the doffing unit performs its doffing service at a spinning station only when no package is present on the conveyor at a doffing position corresponding to the station at which the doffing unit is then stopped, but it defers its doffing operation at said station if any package is present at said position on the conveyor. When the number of those full packages which are still undoffed and therefore reserved for later doffing amounts to a predetermined value, the conveyor is moved to discharge the doffed packages thereby to clear the conveyor.

This method of package transferring according to the above Application is disadvantageous in that the production efficiency of the machine may be affected depending upon the yarn number count, Ne, of the yarns to be spun on the machine. That is, in spinning finer count yarns which require a longer time for forming a full package of yarn at each of the spinning stations, the number of full packages which may be formed, and therefore which need be doffed on the machine in a given length of time is relatively few. Therefore, reservation of doffing at a spinning station due to the presence at its doffing position on the conveyor of any previously-doffed package takes place less frequently, which means less reduction in productive time of the spinning machine. Whereas, in producing packages from thicker count yarns calling for rather short times for forming full packages of the same size as in the above case, the number of packages to be completed on the machine in the same given length of time will naturally be increased. For example, in spinning yarns with a metric yarn number count Ne 6 at a spinning speed of 200 m/min for forming full packages with a diameter of 300 mm, it takes about three hours to complete a full package at each of the stations. On a spinning frame including as many as 192 working stations, a full package which needs be doffed will be formed approximately every minute. If the package forming time is thus reduced, as it would be now apparent to those skilled in the art, the reservation of doffing service takes place more frequently, thus increasing the dwell time when no yarn is spun out because no spinning operations are carried out at the spinning stations where doffing of their packages is reserved at least until the doffing unit comes again to such stations.

The result is, as a matter of course, that the production efficiency of the machine will be affected by the prolonged periods of time when no yarn is produced at any of the working stations, in particular when spinning thick count yarns.

SUMMARY OF THE INVENTION

Accordingly, an object of the present invention is to remove the aforesaid disadvantages of the prior art methods by providing a method of package transferring in a textile machine such as a spinning frame having at its center a single package transferring conveyor run, by use of which method the undersired interference between full packages at their common doffing position on the conveyor can be prevented with less reduction in production efficiency of the machine.

Another object of the invention is to provide a method of package transferring according to which the mode of operation of the machine can be changed depending upon the yarn number count of the yarns to be spun thereby, so that the reduction in production efficiency of the spinning machine may be minimized in spinning either fine count or thick count yarns.

In a first embodiment of the method according to the invention for transferring yarn packages in a spinning frame having a single package transferring conveyor run extending longitudinally at the center thereof, the movement of the conveyor, which is set normally in a moving state, is interrupted only if there is no doffed package on the conveyor at a doffing position for a spinning station when an automatic doffing unit traveling around the machine comes to and stops at said spinning station, whereupon the doffing unit is operated to perform its doffing service; but the conveyor continues to run, if there is a doffed package at the doffing position, until said position becomes clear of any such package. Doffing of the full package at the spinning station is effected only when such a cleared doffing position is available.

As is apparent from the foregoing, since doffing of a full package at a spinning station is effected only when no doffed package is present at the position where the full package is to be doffed from the station, no damaging interference between packages occurs. By controlling the operation of the package transferring conveyor and the doffing unit in the above method according to the invention, prolonged reservation of undoffed packages can be prevented effectively, in particular, when thick count yarns are produced, whereby a decrease in working efficiency of the machine can be forestalled. Furthermore, arrangement of only a single line transferring conveyor serves to simplify the structure of the machine and reduce the number of parts in the machine, thereby contributing not only to decreasing the cost of manufacture of the equipment, but also to ease of maintenance thereof and also to the space factor in machine installation. In addition, provision of such a single run conveyor makes it easier to connect the conveyor to any package transferring system of a subsequent process for the purpose of automating the package handling in a spinning mill.

According to a second preferred embodiment of the invention, the operation mode of the spinning machine is selected according to the yarn number count of the yarns to be spun by the machine. In one mode of operation which is selected when spinning fine count yarns whose package forming time is longer, the conveyor is set normally in its stopped state. The automatic doffing unit traveling along the respective spinning stations is stopped at a station which calls for doffing of its full package, and then operated to make doffing only if there is no doffed package on the conveyor at a doffing position for the station at which the doffing unit is then stopped. On the other hand, if presence of any doffed package at the position on the conveyor is detected, the doffing unit resumes its traveling motion without performing a doffing service at the station, reserving that station for doffing at a later time. When the stations thus reserved for future doffing total any predetermined number, the conveyor is started for carrying away the doffed full packages stored thereon, thereby to clear the conveyor.

In the other mode of operation which is selected when spinning thick count yarns whose package forming time is rather short, the conveyor is placed normally in its moving state and the spinning machine including the package transferring conveyor and the doffing unit operates substantially in the same way as in the above first preferred embodiment.

Thus with the second embodiment of the method in which either mode of operation of the machine can be selected depending upon the yarn number count of the yarns to be spun, the spinning machine can be operated with a minimum reduction of downtime thereof regardless of the yarn count.

The above and other objects, features and advantages of the present invention Will become more readily apparent to those skilled in the art from the following detailed description of preferred embodiments of the invention, taken in conjunction with the accompanying drawings, wherein:

DETAILED DESCRIPTION OF PREFERRED EMBODIMENTS

Figure 1:
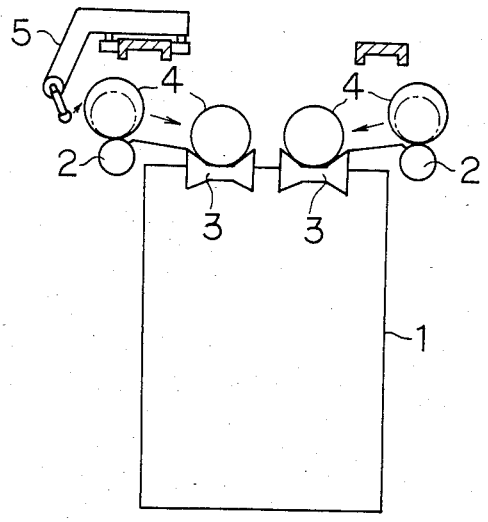
FIG.1 PRIOR ART
FIG. 1 is a schematic diagram showing a conventional method of transferring yarn packages in a spinning frame having two runs of package transferring conveyors.
Figure 2:
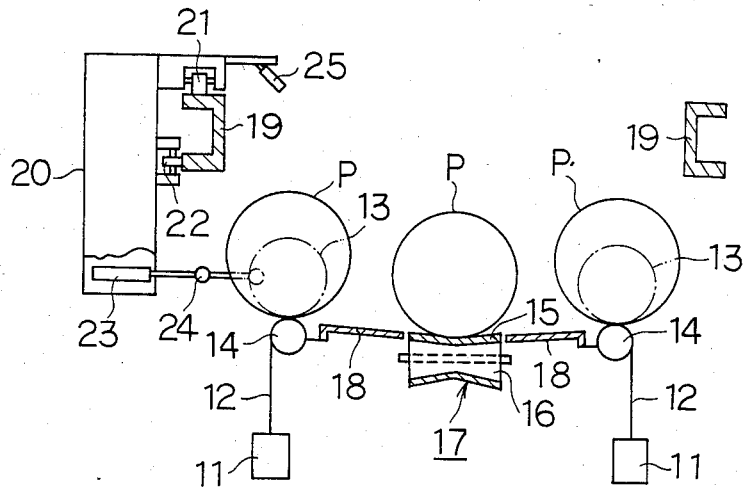
FIG. 2 is a schematic diagram in end view partly in cross section, showing a spinning frame and a doffing unit therefor which are constructed so as to practice the preferred embodiments of the method of yarn package transferring according to the invention.

A first preferred embodiment according to the invention will be described in detail in the following with reference to FIGS. 2, 3, 4(A) and 4(B). A spinning frame which is designated generally by reference numeral 10 has a plurality of spinning units 11, each defining a spinning station thereof, which are juxtaposed in a row on each longitudinal side of the frame. As shown in FIG. 2, a strand of yarn 12 which is spun by and coming out from each spinning unit 11 is wound up into a yarn package 13 by a winding drum 14 which is disposed above and extends along the respective spinning units 11 on each side. On top of the spinning frame 10 and along the longitudinal center thereof is arranged a single line of full package transferring conveyor 17 which includes an endless belt 15 and a pulley 16 for driving said belt 15. A guide plate 18 is arranged on each side of the conveyor 17 so as to receive and guide a full package P doffed from an adjacent spinning station onto the conveyor belt 15.

Figure 3:
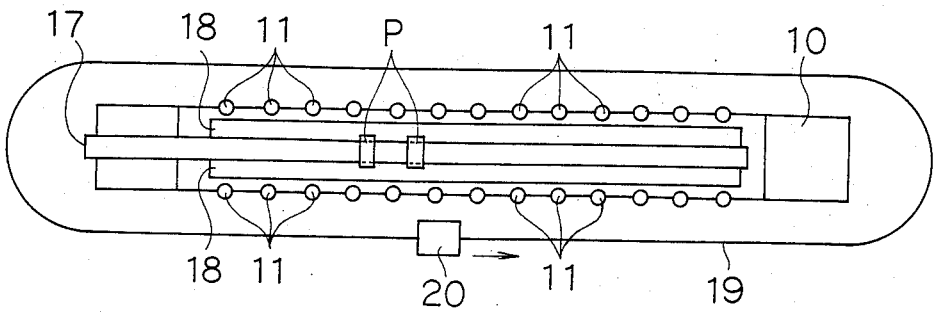
FIG. 3 is a schematic diagram in plan view of the spinning frame of FIG. 2.

A guide rail 19 is disposed in such a way as to surround the spinning frame 10 as shown in FIG. 3, and a doffing unit 20 which is designed to remove or doff a full package at each of the spinning stations is moveably carried, as shown in FIG. 2, by the guide rail 19 via a drive roller 21 and a guide roller 22 so that the doffing unit 20 may travel therealong, therefore along the individual spinning units 11 on both sides of the machine 10. The doffing unit 20 is equipped at its bottom with a pusher roller 24 which is operated by a cylinder 23 for doffing a full package P by pushing it out of its winding position onto the conveyor belt 15, and at its top with a photo-electric device 25 of a type which detects a full package P, if any, already doffed and present at a doffing position for each spinning station on the conveyor 17, by emitting a beam of light against the doffed full package on the conveyor. The conveyor 17 and the doffing unit 20 of the spinning frame 10 are operated under the control of the electric circuts shown in FIGS. 4(A) and 4(B), as follows.

Figure 4A:
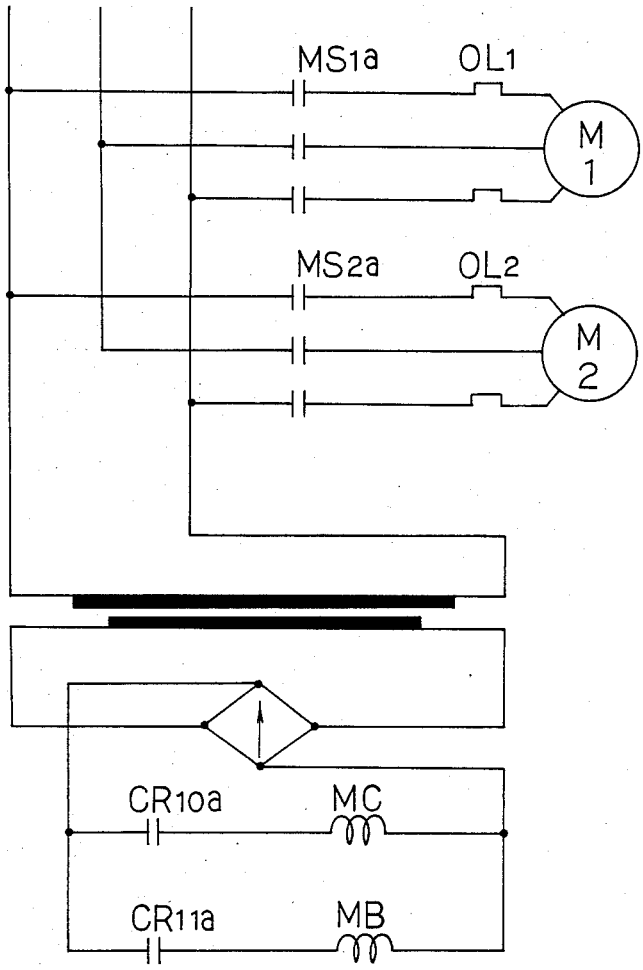
FIGS. 4(A), 4(B) and 4(C) are wiring diagrams of electric circuits for controlling the operation of the doffing unit and the package transferring conveyor on the spinning frame.
Figure 4:
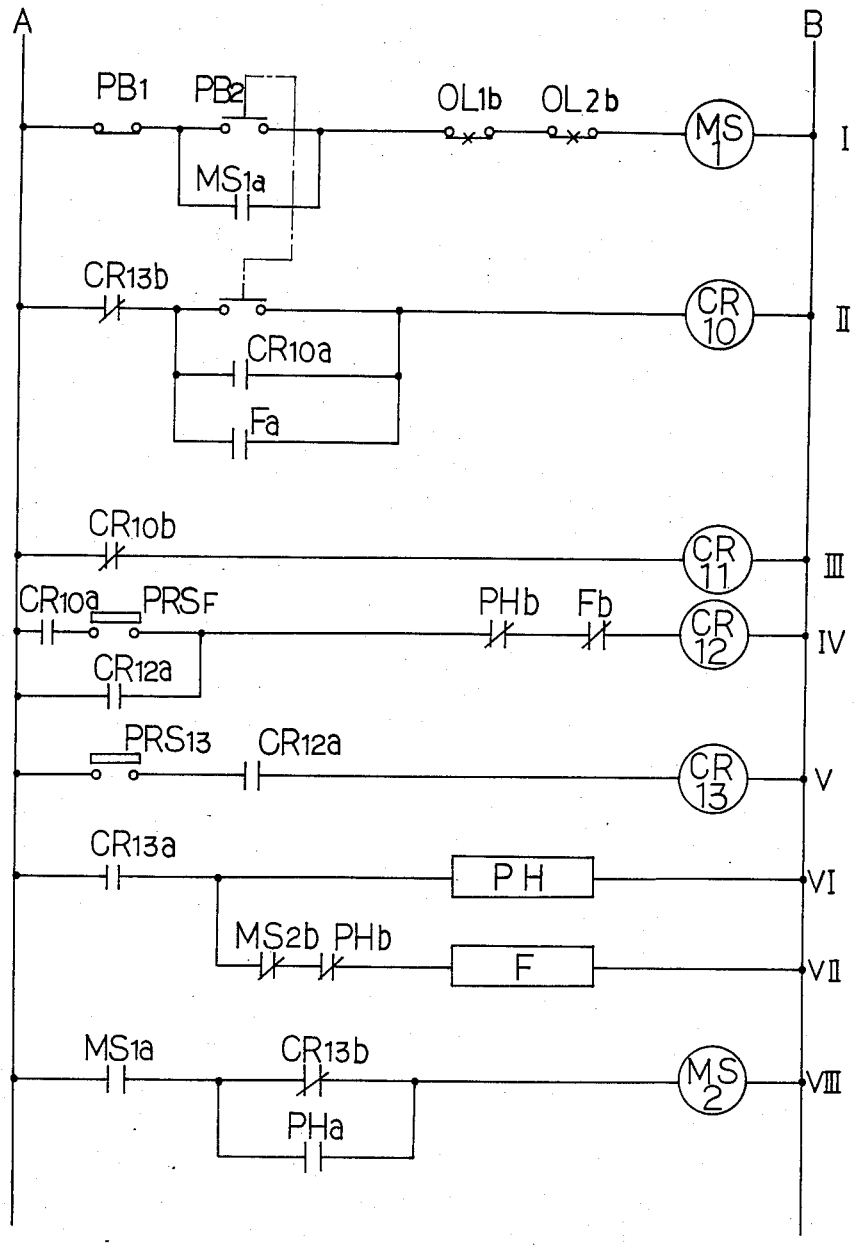

In FIGS. 4(A) and 4(B), M1 represents a motor for driving the doffing unit 20 to move along the guide rail 19 and M2 a motor for driving the conveyor 17. The motor M1 is started by closing a magnetic switch MS1; while the motor M2 is initiated by energizing a magnetic switch MS2. MC represents a clutch coil which, when excited, acts to engage a clutch of the doffing unit 20, and MB a brake coil which, when excited, applies a brake to the doffing unit 20. These coils MC and MB are excited by energizing relays CR10 and CR11, respectively. In order to stop the traveling motion of the doffing unit 20, its clutch is disengaged and its brake is applied. A reverse procedure is used to allow the unit 20 to resume its traveling along the rail 19.

$PRS_F$ in circuit IV in FIG. 4(B) designates a proximity switch which is closed when it receives a full-package signal provided by a spinning station where a full package has been formed. PH in circuit VI is a photoelectric switch which is operated when it detects the presence of any doffed full package at a doffing position on the conveyor 17 of a spinning station where the doffing unit 20 is then stopped.

Closing a pushbutton switch PB2 in circuit I, the magnetic switch MS1 in the same circuit is energized, closing its associated NO (or normally-open) contact points MS1*a* thereby to place the switch MS1 in a self-held state and simultaneously initiating the doffing unit drive motor M1. Closure of the switch PB2 simultaneously energizes the relay CR10 connected in circuit II, closing its NO contact points CR10*a* thereby to place the relay CR10 in a self-held state and, at the same time, exciting the coil MC to engage the clutch of the doffing unit 20. Simultaneously with the above operation of the relay CR10, its associated NC (or normally-closed) contact points CR10*b* in circuit III are opened to de-energize the relay CR11. Thus the current flowing in the coil MB is shut off thereby causing the doffing unit brake coil MB to be de-energized. Therefore, the doffing unit brake is released and the doffing unit 20 is allowed to start its traveling along the guide rail.

In synchronism with the start of the doffing unit 20, NO contact points MS1*a* in circuit VIII associated with the magnetic switch MS1 are closed thereby to energize the magnetic switch MS2 in the same circuit so that its associated NO contact points MS2*a* are closed to initiate the conveyor drive motor M2. In this way, the conveyor belt 15 is driven via the driving pulley 16.

While the doffing unit 20 is traveling at a given speed along the rail 19 disposed around the spinning frame 10, a strand of yarn 12 is produced by each of the spinning units 11 and wound into a yarn package 13 by the winding drum 14. As the package 13 increases its diameter with progression of such spinning and winding operation substantially to a predetermined size as indicated by reference symbol P, the spinning unit 11 stops its operation automatically and is placed in a ready-for-doffing state with a full-package signal provided thereby. The full-package signal may be provided in any convenient way, e.g. by protruding of a projection which may be sensed by the proximity switch $PRS_F$ mounted on the doffing unit 20.

As the traveling doffing unit 20 nears the spinning station which has thus provided the full-package signal designating the need for doffing of its full package P, the proximity switch $PRS_F$ on the doffing unit 20 detects the full-package signal. Accordingly, the contact points of the switch $PRS_F$ are closed thereby to energize a relay CR12 in the same circuit IV, said relay CR12 then being self-held by closing its associated NO points of contact CR12*a*. Simultaneously, the other NO contact points CR12*a* in circuit V are also closed. As the stop position of the spinning station is reached by the doffing unit 20, the contact points of a proximity switch PRS13 in circuit V for locating the unit at its stop position of the spinning station are closed thereby to energize its associated relay CR13. Consequently, NC contact points CR13*b* in circuit II are opened to break the same circuit, thus de-energizing the relay CR10 with the result that the doffing unit clutch is disengaged. Simultaneously with the de-energization of the relay CR10, its associated NC contact points CR10*b* in circuit III are closed again to turn on the brake control relay CR11 in the same circuit, thus resulting in application of the doffing unit brake. In this way, the doffing unit 20 is caused to stop at the stop position of the designated spinning station.

Using its photo-electric device 25, the doffing unit 20 then located at the stop position checks for the presence of any full package P which has already been doffed and placed on the conveyor 17 at the position corresponding to the designated spinning station at which the doffing unit 20 is currently stopped. If no such package is detected by the photo-electric device 25, the photoelectric switch PH associated therewith and connected in circuit VI remains in its de-energized state. Accordingly, its NC contact points PHb in circuit VII retain their closed state and NO contact points PHa in circuit VIII their open state, respectively. Because the NC contact points CR13*b* in circuit VIII have been already opened by energization of the relay CR13, the conveyor control magnetic switch MS2 is deenergized to stop the conveyor 17. Simultaneously with the de-energization of MS2, the NC contact points MS2*b* associated therewith and connected in circuit VII resume their original closed state, thus allowing current to flow in doffing control circuit F in the same circuit VII. Accordingly, the doffing unit 20 is operated to perform its doffing service at the designated spinning station under the control of the doffing control circuit F. In the doffing operation, the pusher roller 24 mounted at the bottom of the doffing unit 20 is actuated to push the full package P for displacing it from its winding position onto the conveyor 17. When such doffing operation has been completed, a doffing-complete signal is transmitted which acts to close NO contact points Fa in circuit II and open NC contact points Fb in circuit IV, respectively. Consequently, the relay CR12 in circuit IV is de-energized to allow its NO contact points CR12*a* in circuit V to resume their original open state, thereby de-energizing the relay CR13. Accordingly, the NC contact points CR13*b* in circuit II are closed to turn on the relay CR10. Because the NO contact points CR10*a* are then closed, the relay CR10 is placed in a self-held state. Making of the circuit II in turn breaks the circuit III because the NC contact points CR10*b* associated with CR10 are caused to open, thereby de-energizing the relay CR11. As a result, the doffing unit clutch is engaged and its brake is released so that the doffing unit 20 may resume its traveling along the guide rail 19.

Simultaneously with the restart of the doffing unit 20, the contact points of the proximity switch PRS13 in circuit V are opened to de-energize their associated relay CR13 in the same circuit. Therefore, the NC contact points CR13*b* in circuit VIII are closed to energize the conveyor control switch MS2, and the conveyor 17 is driven so that those full packages P which have been doffed from the respective spinning stations and stored on the conveyor 17 may be transferred to an end of the machine 10 for delivery therefrom by any suitable means (not shown) for transferring to a subsequent process.

Unlike the above case when no full package is detected by the photo-electric device 25, if any doffed full package P is present at the aforesaid doffing position on the conveyor 17, the photo-electric switch PH is turned on and its NC contact points PHb are opened. Therefore, no current flows in the doffing control circuit F, so that no doffing service is provided by the doffing unit 20 at the designated station. Simultaneously, closure of the photo-electric switch PH causes the NO contact points PHa in circuit VIII to be closed, so that the magnetic switch MS2 retains its energized state and, therefore, the transferring conveyor 17 continues to run. As the full package P is moved with the conveyor 17 away from the doffing position corresponding to the designated spinning station and no package is there, the photo-electric switch PH is turned off and the conveyor 17 is caused to stop and the doffing unit 20 performs its doffing service according to the sequence of control as described earlier. After the doffing service is over, the transferring conveyor 17 is driven again and the doffing unit 20 resumes its traveling along the rail 19.

OL1 and OL2 in FIG. 4(A) are overload relays. When as the result of an electric trouble a current overload is sent to motors M1 and M2 in FIG. 4(A), the relays OL1 and OL2 in FIG. 4(A) are energized, and their respectively associated NC contact points OL1*b* and OL2*b* in circuit I in FIG. 4(B) are opened. Each of the circuits then works in the following way:

(1) Magnetic switches MS1 and MS1*a* in circuit I are de-energized;
(2) NO contact point MS1*a* in circuit VIII and FIG. 4(A) is opened, and motor M1 is stopped;
(3) Magnetic switch MS2 in circuit VIII is de-energized;
(4) NO contact point MS2*a* in FIG. 4(A) is opened; and
(5) Motor M2 is stopped.

Thus, overload relays OL1 and OL2 prevent damage to motors M1 and M2 owing to a trouble.

A second preferred embodiment of the invention will now be explained with reference to FIGS. 2, 3, 4(A) and 4(C) in the following.

Figure 4C:
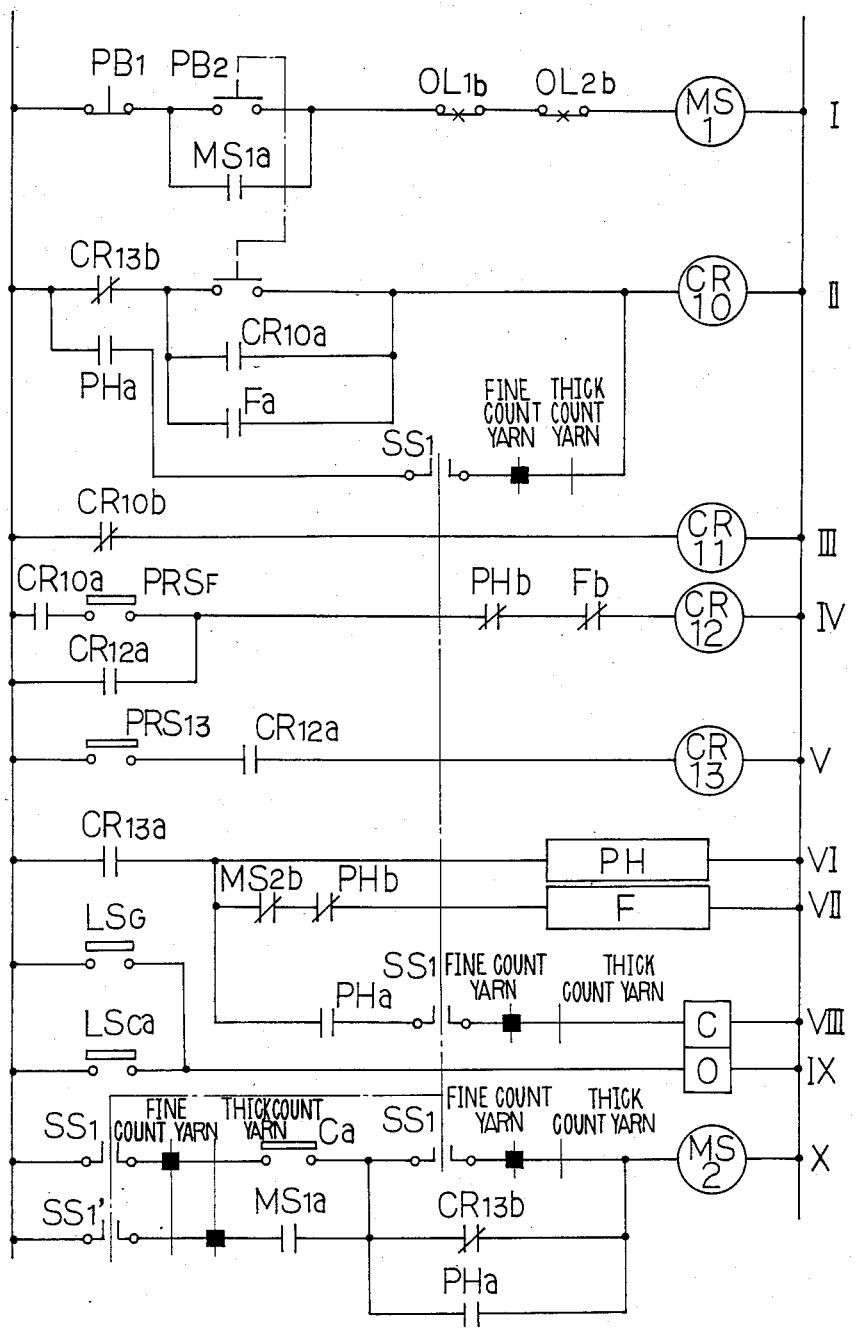

The control circuit of FIG. 4(C) used for practicing the second embodiment differs most from the circuit of FIG. 4(A) in that the former circuit includes mode selector switches SS1, SS1', each having two positions (or ON and OFF), for selecting the operation mode of the spinning machine according to the yarn number count of the yarns to be spun by the spinning frame 10. In the mode for spinning fine count yarns, all the selector switches SS1 in circuits II, VIII and X are set in their ON positions, while the selector switch SS1' in circuit X in its OFF position. In the mode for spinning thick count yarns, on the other hand, all the selector switches SS1 are placed in their OFF positions, while the selector switch SS1' is turned ON.

The operation of the control circuits in the mode of spinning fine count yarns will be explained first. Closing a pushbutton switch PB2 in circuit I with the selector switches SS1 in circuit II, VIII and X, respectively, set ON and the selector switch SS1' in circuit X set OFF, the magnetic switch MS1 is energized, closing its associated NO contact points MS1*a* thereby to place the switch MS1 in a self-held state and simultaneously starting the doffing unit drive motor M1. Simultaneous closing of the switch PB2 energizes the relay CR10 connected in circuit II, closing its contact points CR10*a* thereby to place the relay CR10 in a self-held state and simultaneously exciting the coil MC to engage the clutch of the doffing unit 20. Simultaneously with the above operation of the relay CR10, its associated NC contact points CR10*b* in circuit III are opened to de-energize the relay CR11, so that the current flowing in the coil MB is shut off to cause the doffing unit brake coil MB to be de-energized. Therefore, the doffing unit 20 is started to travel along the guide rail 19.

Unlike the first embodiment, the package transferring conveyor 17 is not caused to start at this time in this mode of operation.

While the doffing unit 20 is traveling at a given speed along the rail 19 disposed around the spinning frame 10, a strand of yarn 12 is produced by each of the spinning units 11 and wound into a yarn package 13 by the winding drum 14. As the package 13 increases its winding diameter substantially to a predetermined size as indicated by P in FIG. 2, the spinning unit 11 stops its operation automatically and is placed in a ready-for-doffing state with a full-package signal provided thereby. The signal may be provided in the same manner as in the first embodiment.

As the traveling doffing unit 20 nears the spinning station which has thus provided the full-package signal designating the need for doffing of its full package P, the proximity switch $PRS_F$ on the doffing unit 20 detects the full-package signal. Accordingly, the contact points of the switch $PRS_F$ are closed thereby to energize the relay CR12 in the same circuit IV, said relay CR1*w* being self-held by closing its associated NO contact points CR12*a*. Simultaneously, the other NO contact points CR12*a* in circuit V are also closed. As the stop position of the spinning station is reached by the doffing unit 20, the contact points of the proximity switch PRS13 in circuit V are closed thereby to energize its associated relay CR13. Consequently, NC contact points CR13*b* in circuit II are opened to break the same circuit, thus de-energizing the relay CR10, with the result that the doffing unit clutch is disengaged. Simultaneously with the de-energization of CR10, its associated NC contact points CR10*b* in circuit III are closed again to turn on the brake control relay CR11 in the same circuit, thus resulting in application of the doffing unit brake. In this way, the doffing unit 20 is caused to stop at the stop position of the designated spinning station.

Using its photo-electric device 25, the doffing unit 20 then located at the stop position checks for the presence of any full package P which has been already doffed and placed on the conveyor 17 at the position corresponding to the designated spinning station, at which the doffing unit 20 is currently stopped. If no such package is detected by the photo-electric device 25, the photoelectric switch PH associated therewith remains in its de-energized state. Accordingly, its NC contact points PHb in circuit VII retain their closed state. Because current is allowed to flow in the doffing control circuit F, the doffing unit is operated to perform its doffing service at the designated spinning station under the control of the doffing control circuit F in the same manner as in the first embodiment. When the doffing operation is over, a doffing-complete signal is transmitted which acts to close the NO contact points Fa in circuit II and open NC contact points Fb in circuit IV, respectively. Consequently, the relay CR12 in circuit IV is turned off to allow its NO contact points CR12*a* in circuit V to resume their original open state, thereby turning off the relay CR13. Accordingly, the NC contact points CR13*b* in circuit II are closed to energize the relay CR10. Because the NO contact points CR10*a* are then closed, the relay CR10 is placed in a self-held state. Making of the circuit II in turn breaks the circuit III because the NO contact points CR10*b* associated with CR10 are caused to open, thereby turning off the relay CR11. As a result, the doffing unit clutch is engaged and its brake is released, so that the doffing unit 20 resumes its traveling along the rail 19.

If any full doffed package is present at the aforesaid doffing position on the conveyor 17 and it is detected by the photo-electric device 25 on the doffing unit, on the other hand, the photo-electric switch PH is turned on and its NC contact points PHb are opened. Therefore, no current flows in the doffing control circuit F and no doffing service is provided accordingly at the designated spinning station. Simultaneously with the energization of the photo-electric switch PH, its NO contact points PHa are closed, thereby allowing current to flow in a counter, which is designated by reference symbol C in circuit VIII, for counting the number of such undoffed stations, in other words the number of full packages which are undoffed and therefore reserved for later doffing. Thus, the counter C is operated to register a count each time a full package on a spinning station is reserved. In addition, closure of the photo-electric switch PH closes the other NO contact points PHa in circuit II, thereby energizing the clutch control relay CR10 and closing its associated NO contact points CR10*a* in circuit II. Because the NC contact points PHb in circuit IV associated with PH are opened, the relay CR12 is turned off. Because the NO contact points CR12*a* are then opened, the relay CR13 in the same circuit V is de-energized to allow the NC contact points CR13*a* in circuit II to close so that the clutch relay CR10 may be placed in a self-held state. Therefore, the coil MC for the brake is de-energized to release the brake of the doffing unit 20. Accordingly, the doffing unit 20 resumes its traveling along the rail 19 until a next full-package signal is detected by its proximity switch $PRS_F$.

As described in the above, each time the photo-electric switch PH in circuit VI is energized, in other words whenever no doffing operation is performed in spite of the fact that the doffing unit 20 is stopped at a spinning station because of the full-package signal having been provided thereby, the station is counted as an undoffed or reserved station by the counter C. As the number of such reserved stations is increased to total to a predetermined value (which may include "one"), the NO contact points Ca in circuit X are closed and the magnetic switch MS2 for controlling the operation of the conveyor drive motor M2 is energized thereby. Energization of the magnetic switch MS2 closes its associated NO contact points MS2*a* to start the conveyor drive motor M2. As a result, the conveyor belt is driven by the motor M2 via the drive pulley 16, so that the full packages P doffed and stored on the belt are conveyed to a discharge end of the machine 10, where they are delivered therefrom by any suitable means (not shown) for transferring to a subsequent process. After all the full packages P on the conveyor 17 have been discharged from the machine 10, the switch LSca in circuit IX is closed and the counter C is thereby zeroed or reset to "0". Simultaneously, the NO contact points Ca in circuit X are opened again to de-energize the switch MS2, with the result that the conveyor drive motor M2 is brought to a stop.

In order to avoid interference between a full package P moving with the conveyor belt 15 and another full package being doffed from a spinning station during movement of the belt, it is desirably so arranged that no doffing takes place while the conveyor 17 is set in motion even if a package at a certain station happens to become full and its full-package signal is detected by the photo-electric device 25 on the traveling doffing unit 20.

As it is now thought by those skilled in the art, since the interval of time between actual doffing operations varies from time to time due to various unpredictable factors such as yarn breaks and reservations of undoffed packages, the sequence in which the spinning stations are to be serviced by the doffing unit 20 will become random. Therefore, the number of full packages P stored on the conveyor 17 during a given length of time after completion of the previous transferring of full packages will vary from time to time as a matter of course.

Furthermore, undoffing of a package during movement of the conveyor 17 means downtime in operation of the spinning machine 10. Therefore, the manner in which the conveyor 17 is driven influences the working efficiency of the spinning machine. To permit the machine to operate with as high efficiency as possible by driving the conveyor 17 at an optimum timing for that purpose, it is desirable that an optimum number of stations to be reserved should be calculated and set in the counter C with various governing factors, such as frequency of yarn breaks, speed at which the doffing unit 20 travels, speed at which the conveyor is driven, spinning conditions, etc., taken into careful consideration.

In order to avoid double counting of the same reserved station by the counter, a reset switch $LS_G$ (in circuit XI) may be provided at an end of the machine 10, which is closed to reset the counter C to "0" if the number of reserved stations fails to total the predetermined value even after a complete turn of the doffing unit 20 around the machine.

The operation for the mode of spinning thick count yarns with all the selector switches SS1 placed OFF and the selector switch SS1' ON will be now explained in the following. By closing the pushbutton switch PB2, the doffing unit 20 is caused to start its traveling in the same sequence of control as in the above-described mode. Simultaneously, the NO contact points MS1*a* associated with the switch MSl are closed to turn on the conveyor drive switch MS2. Because its NO contact points MS2*a* are closed thereby, the conveyor drive motor M2 is started to drive the conveyor belt 15.

As a yarn package 13 becomes full at a spinning station, spinning operation thereat is stopped automatically and the station provides a full-package signal indicating a ready-for-doffing state thereof.

As explained earlier, when the traveling doffing unit 20 comes close to the spinning station, the unit detects the signal and stops at the station, where the photo-electric device 25 on the doffing unit checks whether or not any doffed package is present on the conveyor 17 at the doffing position corresponding to that spinning station. If there is no such package at said doffing position, the photo-electric switch PH in circuit VI remains OFF, and its associated NC contact points CR13*b* in circuit VII and NO contact points PHa in circuit X retain their normally closed and opened positions, respectively. Because the proximity switch PRS13 is closed when the doffing unit 20 is stopped at its servicing position, the relay CR13 is energized thereby and its associated NC contact points CR13*b* in circuit X are opened, so that the conveyor control switch MS2 in the same circuit is de-energized with the result that the conveyor 17 is stopped. Simultaneously, the NC contact points MS2*b* resume their closed state and the NC contact points PHb are also closed. Therefore, the doffing circuit F is actuated to allow the doffing unit 20 to perform its doffing operation in the same way as in the above mode of fine count yarn spinning. After the doffing is over, the doffing unit 20 resumes its traveling along the rail 19.

As the doffing unit 20 thus starts to move, the proximity switch PRS13 in circuit X is opened and the relay CR13 is de-energized thereby. Because its NC contact points CR13*b* in circuit X are closed, the switch MS is turned on, allowing the conveyor 17 to move for transferring the doffed packages P thereon to the delivery end of the spinning frame 10 for discharging them.

If any doffed full package P is detected by the photo-electric device 25, on the other hand, the photo-electric switch PH is turned on and its NC contact points PHb are opened. Therefore, no current flows in the doffing control circuit F, so that no doffing service is then provided at the designated spinning station. Simultaneously, closure of the photo-electric switch PH causes the NO contact points PHa in circuit X to be closed, and thus the switch M2 maintains its energized state. Accordingly, the transferring conveyor 17 continues to run. As the full doffed package P moves with the conveyor 17 away from said doffing position corresponding to the designated spinning station and no package is there, the photo-electric switch PH is turned off and the conveyor 17 is stopped. Then, the doffing unit 20 is actuated to perform its doffing service according to the manner described in detail in a earlier part hereof. After the doffing is completed, the transferring conveyor 17 is driven again and the doffing unit 20 resumes its traveling along the guide rail 19.

It should be noted, in practicing the above second embodiment of the invention, though the thick count yarns generally refer to metric yarn count Ne 10 or less, while the fine count yarns to metric count more than Ne 10, the selection of the operation mode according to the yarn count does not necessarily have to accord with such general classification.

Figure 5:
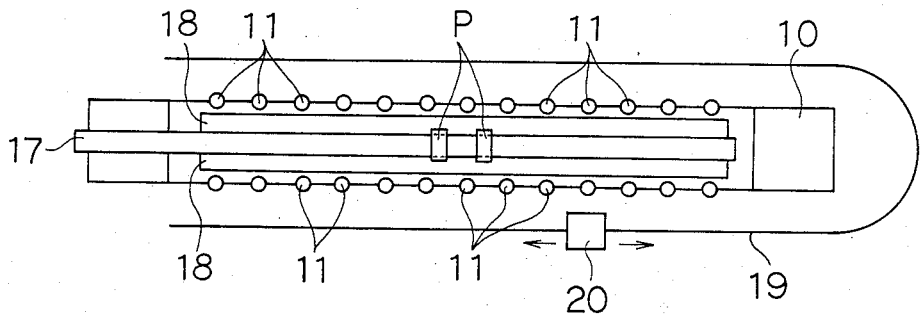
FIG. 5 is a schematic diagram similar to FIG. 3, but showing a modified embodiment of the invention.

As illustrated in FIG. 5 (double arrows), the doffing unit 20 may be arranged so as to move reversibly, or to travel in both directions. Furthermore, it may be contemplated that the counter C is connected with a computer which is so designed to as calculate the optimum number of reservable stations in accordance with varying conditions under which the spinning machine 10 operates, so that the conveyor 17 may be started for transferring doffed packages when the reserved stations total said optimum number.

While the invention has been illustrated and described with reference to specific embodiments thereof, it is to be understood that various modifications in the details of the method may be made without departing from the spirit and scope of the invention.

What is claimed is:

1. A method of transferring yarn packages in a textile machine having a plurality of working stations arranged in a row on each longitudinal side of the machine, a signle run of a normally-moving, endless-type conveyor disposed along the longitudinal center of the machine and a doffing unit for providing doffing of a yarn package at each of the working stations while traveling therearound, said method comprising the steps of:

stopping the doffing unit at a working station which provides a signal calling for doffing of itsd full package;

detecting any package which, if any, has been doffed from any other working station and would then be present on the conveyor at a doffing position corresponding to said working station;

interrupting the conveyor movement and then doffing said full package to said doffing position if no doffed package is detected in said detecting step; but continuing the movement of said conveyor if any doffed package is detected in said detecting step, unitl the doffing position becomes clear of any doffed package, interrupting the conveyor movement when the doffing position becomes clear during the continued movement of the conveyor, and then doffing said full package to said doffing position on the conveyor.

2. A method of transferring yar packages in a textile machine having a plurality of working stations arranged in a row on each longitudinal side of the machine, a single run of an endless-type conveyor disposed along the longitudinal center of the machine and a doffing unit for providing doffing of a yarn package at each of the working stations while traveling therearound, said method in one mode of operation wherein said conveyor is set normally in a stopped state comprising the steps of:

stopping the doffing unit at a working station which provides a signal calling for doffing of its full package;

detecting any package which, if any, has been doffed from any other working station and would then be present on the conveyor at a doffing position corresponding to said working station;

doffing said full package to said doffing position if no doffed package is detected in said detecting step; but reserving said full package for later doffing if any doffed package is detected in said detecting step, and allowing the doffing unit to resume its traveling without performing any doffing service thereat;

driving said conveyor to convey the doffed package or packages placed thereon, when the number of each package or packages which is or are reserved for later doffing amounts to a predetermined value, for clearing said conveyor of said doffed package or packages; said method in a second mode of operation wherein said conveyor is set normally in a moving state comprising the steps of:

stopping the doffing unit at a working station which provides a signal calling for doffing of its full package;

detecting any package which, if any, has been doffed from any other working station and would then be present on the conveyor at a doffing position corresponding to said working station;

interrupting the conveyor movement and then doffing said full package to said doffing position if no doffed package is detected in said detecting step; but continuing the movement of said conveyor if any doffed package is detected in said detecting step, until the doffing position becomes clear of any doffed package, interrupting the conveyor movement when the doffing position becomes clear during the continued movement of the conveyor, and then doffing said full package to said doffing position on the conveyor.

3. A method according to claim 1, which comprises moving said doffing unit in only one direction around the working stations.

4. A method according to claim 1, which comprises moving said doffing unit in either direction around the working stations.

5. A method according to claim 2, which comprises selecting said one mode of operation when spinning fine count yarns, and selecting said second mode of operation when spinning thick count yarns.

6. A method according to claim 2, which further comprises counting said number of package or packages reserved for later doffing using a counter which is operatively connected with a computer which determines an optimum number of package or packages to be reserved in accordance with varying conditions under which the machine is operated, and moving said conveyor when said optimum number is counted.

* * * * *